US008695711B2

(12) United States Patent
Kocaman et al.

(10) Patent No.: US 8,695,711 B2
(45) Date of Patent: Apr. 15, 2014

(54) SUBSEA WELL CONTAINMENT AND INTERVENTION APPARATUS

(75) Inventors: Alp A. Kocaman, Houston, TX (US); John George Nolte, III, Houston, TX (US)

(73) Assignee: J. Ray McDermott, S.A., Houston, TX (US)

( * ) Notice: Subject to any disclaimer, the term of this patent is extended or adjusted under 35 U.S.C. 154(b) by 216 days.

(21) Appl. No.: 13/150,405

(22) Filed: Jun. 1, 2011

(65) Prior Publication Data

US 2011/0297390 A1 Dec. 8, 2011

Related U.S. Application Data

(60) Provisional application No. 61/351,361, filed on Jun. 4, 2010.

(51) Int. Cl.
*E21B 33/035* (2006.01)

(52) U.S. Cl.
USPC ..... 166/363; 166/351; 166/386; 166/79.1; 405/60

(58) Field of Classification Search
USPC ..... 166/360, 338, 339, 341, 351, 363, 368, 166/386, 85.1, 85.5, 79.1, 96.1; 405/224, 405/228, 232, 60
See application file for complete search history.

(56) References Cited

U.S. PATENT DOCUMENTS 3,099,316 A * 7/1963 Johnson ..... 166/340
3,548,605 A * 12/1970 Armistead et al. ..... 405/60
3,578,233 A * 5/1971 Meister et al. ..... 228/5.1
3,741,320 A * 6/1973 Hilfing ..... 175/6
4,043,407 A * 8/1977 Wilkins ..... 175/50
4,218,158 A * 8/1980 Tesson ..... 405/170
4,229,121 A * 10/1980 Brown ..... 405/158
4,417,624 A * 11/1983 Gockel ..... 166/351
4,432,671 A * 2/1984 Westra et al. ..... 405/226
4,461,354 A * 7/1984 Buras et al. ..... 166/343
4,643,616 A * 2/1987 Castel et al. ..... 405/191
5,213,157 A * 5/1993 Wills ..... 166/79.1
5,361,840 A * 11/1994 Matthews ..... 166/285
5,794,706 A * 8/1998 Alhamad ..... 169/69
6,116,347 A * 9/2000 Alhamad ..... 169/46
6,189,620 B1 * 2/2001 McDowell ..... 166/379
6,273,645 B1 * 8/2001 Hamre ..... 405/224.1
6,443,660 B1 * 9/2002 Smith et al. ..... 405/224
6,454,011 B1 * 9/2002 Schempf et al. ..... 166/381
6,488,093 B2 * 12/2002 Moss ..... 166/339
6,488,094 B1 * 12/2002 McDowell ..... 166/379
6,659,180 B2 * 12/2003 Moss ..... 166/339
7,036,598 B2 * 5/2006 Skjærseth et al. ..... 166/339
7,341,109 B1 * 3/2008 McDowell ..... 166/379
7,380,614 B1 * 6/2008 Williamson et al. ..... 175/6
7,600,570 B2 * 10/2009 Haughom ..... 166/358
8,282,316 B2 * 10/2012 Breivik ..... 405/203
2010/0147526 A1 * 6/2010 Haughom ..... 166/338
2011/0088911 A1 * 4/2011 Boyce et al. ..... 166/361
2011/0158752 A1 * 6/2011 Hitchin ..... 405/232
2011/0274493 A1 * 11/2011 Cutts ..... 405/60

* cited by examiner

*Primary Examiner* — Matthew Buck
(74) *Attorney, Agent, or Firm* — D. Neil LaHaye

(57) ABSTRACT

A subsea well containment and intervention apparatus. The invention provides a rigid frame that includes a set of pilings for securely affixing the apparatus to the seafloor. Buoyancy modules included in the frame make the weight of the invention more manageable when in the water. Lifting eyes are provided on the frame for installation and removal. A series of tools are attached to the frame to eliminate the need for frequent trips to the surface to replace and replenish.

15 Claims, 3 Drawing Sheets

SUBSEA WELL CONTAINMENT AND INTERVENTION APPARATUS

PRIORITY CLAIM

This application claims priority from Provisional Application Ser. No. 61/351,361 filed Jun. 4, 2010.

FIELD AND BACKGROUND OF INVENTION

The invention is generally related to subsea well bores and more particularly to a subsea well containment and intervention apparatus.

Containment of a leak and intervention of an offshore subsea well poses significant risks.

The main tool for intervention is an ROV (remotely operated vehicle) and this tool may be well suited for observation and carrying out small tasks. However, heavy tools requiring high loads are required for any subsea well intervention.

One has to keep in mind the significant pressures encountered in an oil well. Pressures of 10,000+ psi are common place. Managing a simple task may become impossible due to the high pressures encountered.

In addition, the integrity of the well and its attachments are usually in question when intervention is required. The well components must be handled delicately for fear that further damage can be caused.

ROV's do not have the necessary power needed to handle large size tools and strength required to manage the intricate maneuvers. Limited capability of the ROV's puts a serious restriction on the range of operations possible.

ROV's are limited in their endurance and flexibility. They will have to return to the surface for maintenance, and replenishment of tools or consumables. Return to the surface is a slow process. When time is of the essence in any leak containment or intervention operation, the functionality of the ROV is questioned.

SUMMARY OF INVENTION

The present invention addresses the problems in the known art. The invention provides a rigid frame that includes a set of pilings for securely affixing the apparatus to the seafloor. Buoyancy modules included in the frame make the weight of the invention more manageable when in the water. Lifting eyes are provided on the frame for installation and removal. A series of tools are attached to the frame to eliminate the need for frequent trips to the surface to replace and replenish.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

The subsea well containment and intervention apparatus 10 is generally comprised of a frame 12, buoyancy modules 14, piles 16, a series of tools, and means for controlling the tools.

Figure 1:
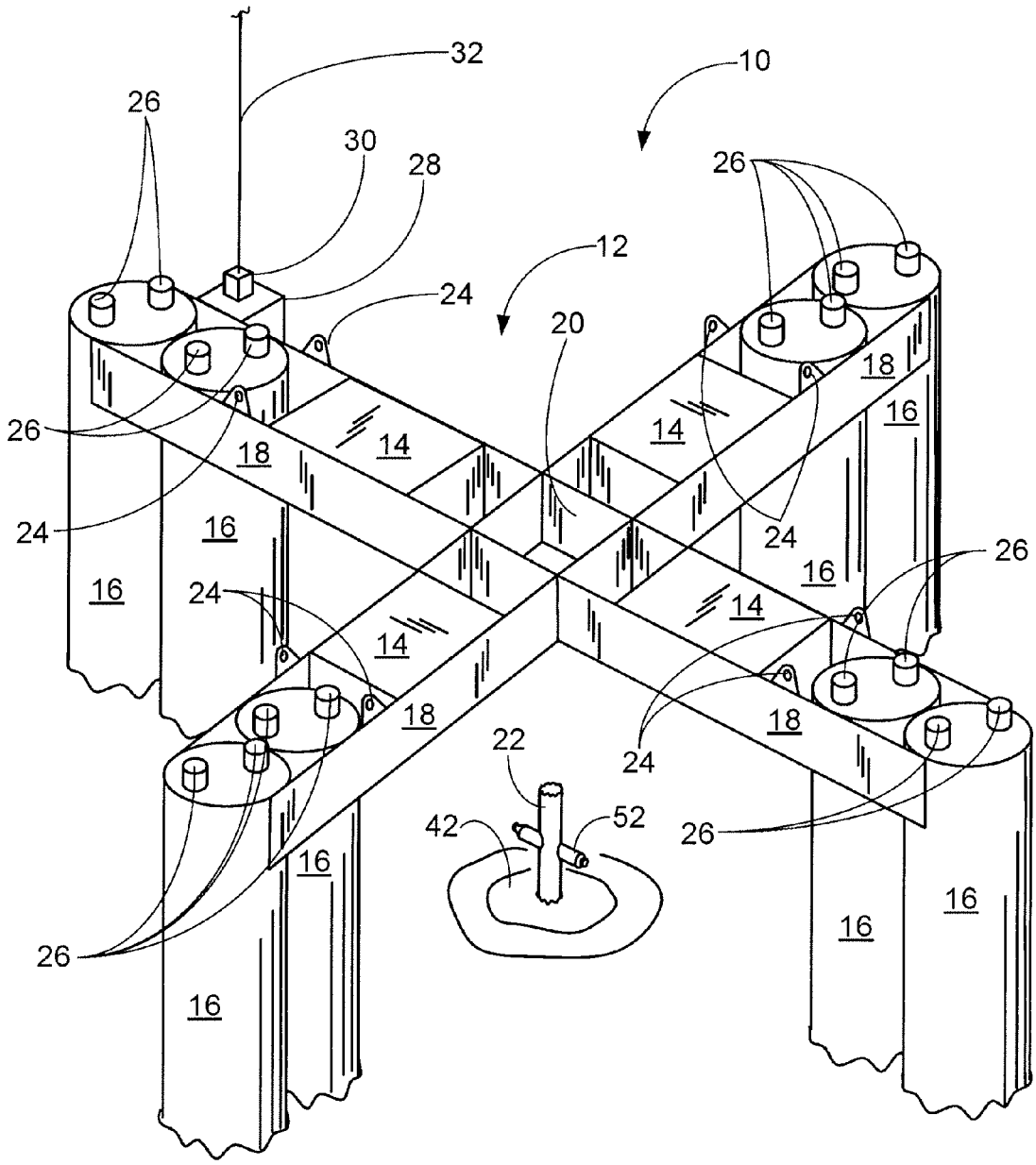
FIG. 1 is a general isometric view of the basic components of the invention.

As seen in FIG. 1, the frame 12 is preferably formed from a plurality of steel beams 18 attached together. It is preferred they form essentially a cross or X shape. The steel beams 18 are preferably sized to handle a minimum of 10,000 tons of force both upwards and downwards. The size and length of the steel beams 18 are selected to suit the most common offshore sites.

The beams 18 are attached together so as to define an open central well 20 which can be placed over the well head 22. The open central well 20 allows the use of tools stowed on the apparatus 10 for working on the subsea well.

A plurality of lifting eyes 24 are rigidly attached to the frame 12 to provide attachment points for lifting and lowering the apparatus 10 to the seafloor.

A plurality of pilings 16, also referred to as piles (one or more at each end of the frame 12) are provided and are rigidly attached to the steel beams 18. Piles 16 are preferably suction piles. At least one evacuation pump 26 is provided on each pile 16, which is closed at the upper end. The diameter and length of the piles 16 are selected to suit the most common offshore sites and soil conditions. The piles 16 are used to establish the apparatus 10 in place around the well head 22.

As known in the offshore industry, suction piles are open at the lower end and closed at the upper end and eliminate the need for a pile driving device by placing the lower open end of the pile on the seafloor and using an evacuation pump to remove air and water from the interior of the pile. The negative pressure created inside the pile causes the pile to be pushed into the soil by the external water pressure on the pile which is greater than the internal pressure.

It is preferable that the evacuation pumps 26 be of the positive displacement type and it is estimated that they should be able to create at least 2,500 psi differential pressure or more using either electrical or hydraulic power.

The evacuation pumps 26 are connected to a pump control center 28 that is preferably located on one of the steel beams 18. An umbilical connector 30 mounted on the same steel beam as the pump control center 28 is used to bring aboard a control, electrical, and hydraulic umbilical line 32.

Buoyancy modules 14 serve to reduce the effective submerged weight of the apparatus 10 and make handling from the surface more manageable. While any suitable type of buoyancy module may be used, syntactic foam buoyancy modules are preferred.

Figure 2:
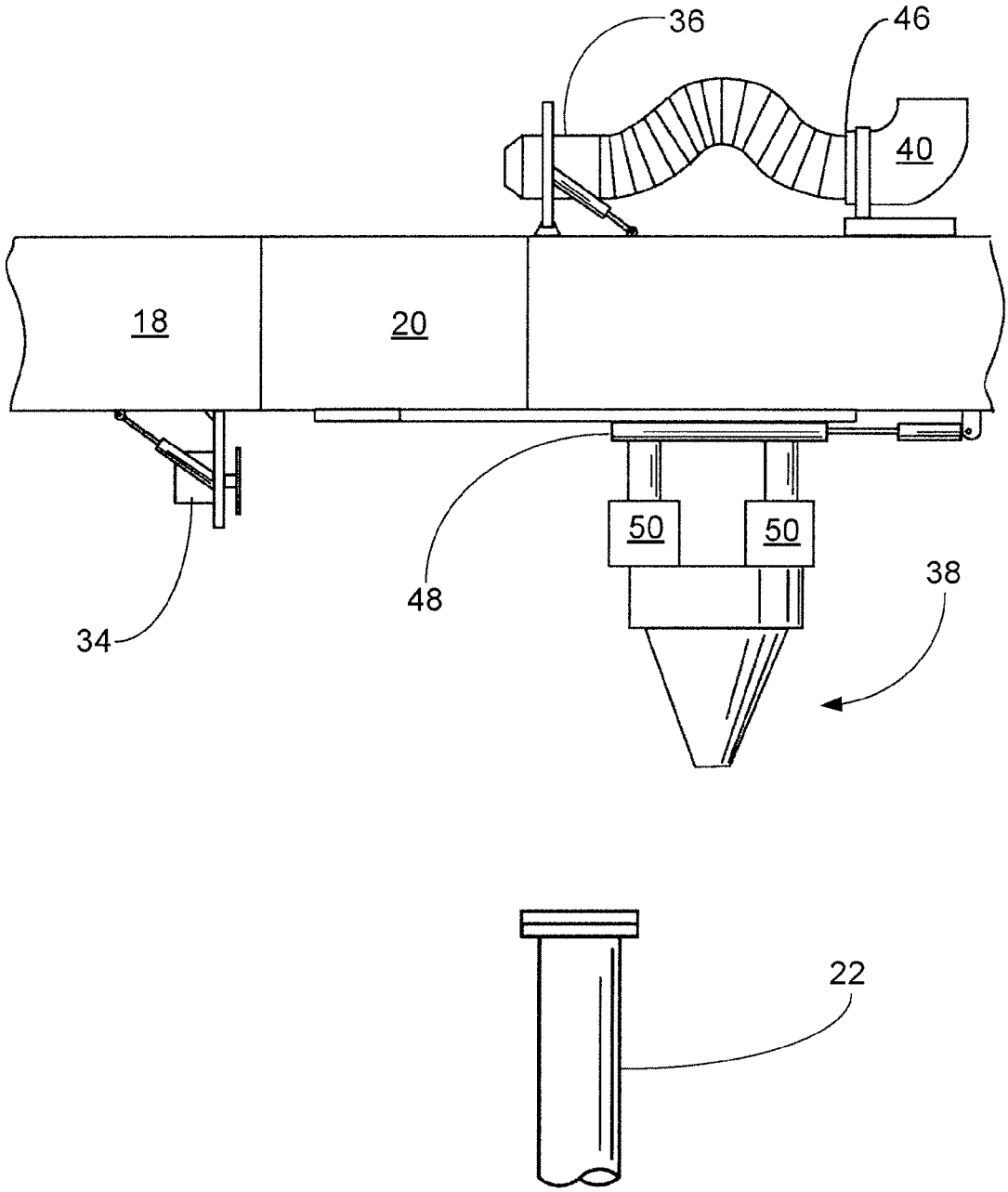
FIG. 2 illustrates the steel beams and tools used with the invention.

As indicated above, a series of tools may be provided on the apparatus 10. FIG. 2 illustrates some examples of possible tools that can be used such as a wellhead cleaning tool 34, a flow control tool 36, a pressure plug ram 38, or a pipe connector 40. The tools are normally kept in their stowed position and deployed as required for use once the apparatus 10 is installed on the seafloor 42. Using the top and bottom of the frame 12, as many as eight tools can be installed on the apparatus 10, thus minimizing or eliminating the need for repeated trips to the surface. Jacks 44 can be used for positioning the tools. Umbilical line 32 extends from a surface support vessel and is connected to umbilical connector 30 that serves as means for providing electrical and hydraulic power to and controlling the tools. Power and control lines not shown are provided on the frame 12 as needed for the tools.

A wellhead cleaning tool 34 can be used to prepare a damaged well head for being capped or being connected to a flow control tool 36 such as that illustrated in FIG. 2. Jack 44 is used to move the flow control tool 36 into fluid communication with the well head 22 such that the oil and/or natural gas from the well flows through a flow diverter riser 46 into pipe connector 40 and into a pipe or riser not shown for safely diverting oil and/or natural gas from a damaged well.

Figure 3:
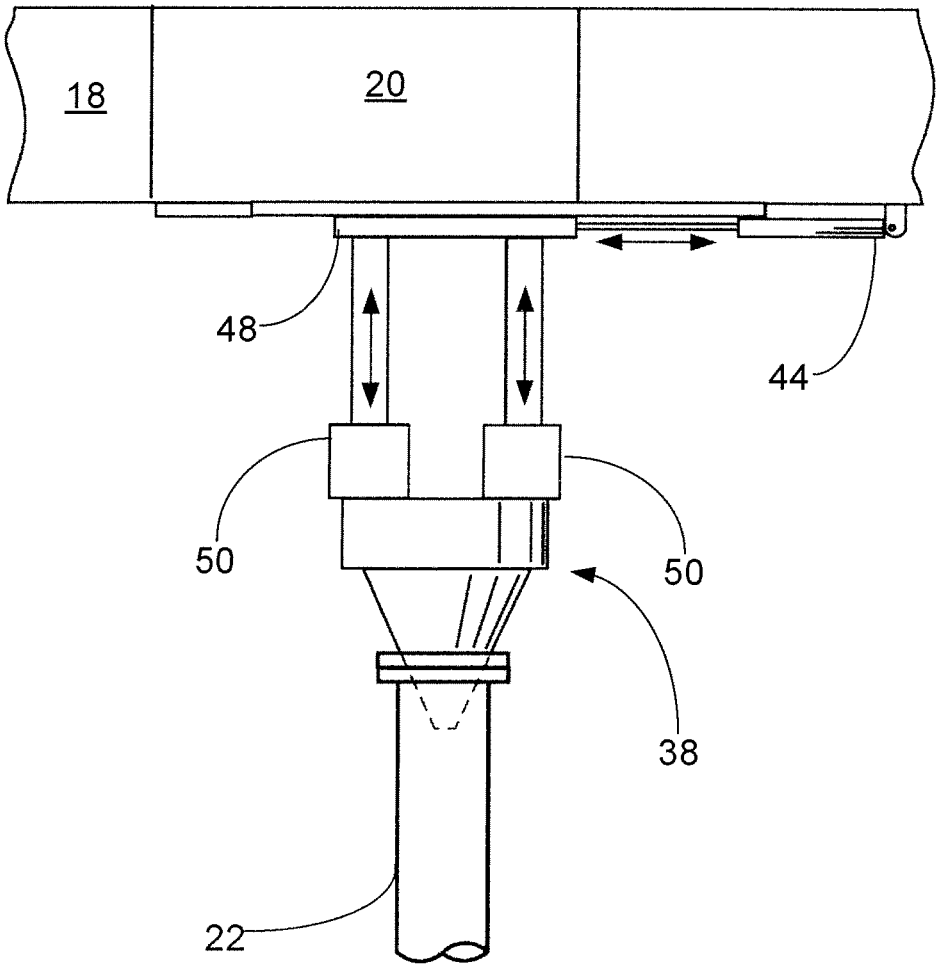
FIG. 3 illustrates the positioning of the invention over a well head.

FIGS. 2 and 3 illustrate a pressure plug ram 38 mounted on a skid plate 48 via extension jacks 50. The skid plate 48 is movably mounted on the frame 12 and moved between positions by a jack 44. As seen in FIG. 3, the pressure plug ram 38 has been moved from a first retracted position to a second deployed position where it is aligned with the central well 20 and the well head 22. The extension jacks 50 are used to force the pressure plug ram 38 into the well head 22 to block the flow of oil and/or natural gas from the well into the surrounding environment.

While only the pressure plug ram 38 is shown as being mounted on a skid plate 48 for movement during work on a well head, it should be understood that skid plates may be used for all of the tools to provide the greatest versatility for movement and working capability.

The control, electrical, and hydraulic umbilical line 32 provides a continuous supply of power to the tools.

The flow control tool 36 is connected to the flow diverter riser 46 that takes the flow away from the well head and through a riser to the surface.

One special tool is the pressure plug ram 38. As the steel beams 18 are designed for 10,000 tons force, the pressure plug ram 38 is placed on either side and can exert the maximum force on top of the well head 22 to plug the well totally independent of the well and wellhead components 52. As shown in FIG. 3, the pressure plug ram 38 is brought directly over the well head 22 and using the extension jacks 50 the leaking well is sealed.

In operation, the apparatus 10 is lowered by a surface vessel using lifting eyes 24 and positioned above a subsea well head 22. Once the piles 16 contact the seafloor 42 the evacuation pumps 26 are activated to drain water and air from the piles 16. The pressure differential between the inside and outside of the piles causes the piles to be driven into the seafloor 42 and fix the apparatus 10 in place. Tools such as the well head cleaning tool 34, the flow control tool 36, or the pressure plug ram 38 are then used as needed to properly capture and direct the flow of oil and/or natural gas or to plug the well. When the work is completed and there is no longer a need for the apparatus 10 at the site, the evacuation pumps 26 can be used to pump water into the piles and create a pressure differential that pushes the piles out of the seafloor 42 and allow apparatus 10 to be lifted to the surface and recovered for reuse at another location.

The invention provides several advantages.

It provides a strong, rigid and stable platform in and around the subsea wellhead.

It provides a platform where a multitude of tools can be placed onboard prior to deployment and can be used independently.

It provides means of exerting a significant amount of force independent of the well and well head components.

It provides a steady stream of power to the tools.

The apparatus is removable and reusable.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed as invention is:

1. A subsea well containment and intervention apparatus, comprising:

a. a frame having an open central well designed to be received over a damaged, leaking wellhead;

b. a plurality of pilings attached around the periphery of the frame for securing the apparatus on the seafloor, allowing the generation of forces during subsea well intervention beyond the weight of the apparatus while maintaining the apparatus in position on the seafloor;

c. a plurality of tools mounted on the frame for working on the subsea well, the tools being offset from the center of the frame; and d. means for powering and controlling the tools.

2. The subsea well containment and intervention apparatus of claim 1, wherein the pilings are suction pilings.

3. The subsea well containment and intervention apparatus of claim 2, further comprising at least one evacuation pump mounted on each piling for securing the pilings in the seafloor.

4. The subsea well containment and intervention apparatus of claim 1, wherein the means for powering and controlling the tools comprises an umbilical line connector for receiving a power and control umbilical line from a support vessel.

5. The subsea well containment and intervention apparatus of claim 1, wherein the tools for working on the subsea well are movably mounted on the frame.

6. The subsea well containment and intervention apparatus of claim 1, further comprising at least one buoyancy module mounted on the frame.

7. A subsea well containment and intervention apparatus, comprising:

a. a frame having an open center well designed to be received over a damaged, leaking wellhead;

b. a plurality of suction pilings attached around the periphery of the frame for securing the apparatus on the seafloor, allowing the generation of forces during subsea well intervention beyond the weight of the apparatus while maintaining the apparatus in position on the seafloor;

c. a plurality of tools mounted on the frame for working on the subsea well, the tools being offset from the center of the frame; and d. an umbilical line connector for receiving a power and control umbilical line from a support vessel for powering and controlling the tools.

8. The subsea well containment and intervention apparatus of claim 7, further comprising at least one evacuation pump mounted on each piling for securing the pilings in the seafloor.

9. The subsea well containment and intervention apparatus of claim 7, wherein the tools are movably mounted on the frame.

10. The subsea well containment and intervention apparatus of claim 7, further comprising at least one buoyancy module mounted on the frame.

11. The subsea well containment and intervention apparatus of claim 7, further comprising a plurality of lifting eyes attached to the frame.

12. A subsea well containment and intervention apparatus, comprising:

a. a frame having an open central well designed to be received over a damaged, leaking wellhead;

b. a plurality of suction pilings attached around the periphery of the frame for securing the apparatus on the seafloor, allowing the generation of forces during subsea well intervention beyond the weight of the apparatus while maintaining the apparatus in position on the seafloor;

c. a least one evacuation pump mounted on each piling for securing the pilings in the seafloor;

d. a plurality of tools mounted on the frame for working on the subsea well, the tools being offset from the center of the frame, with at least one tool being movably mounted on the frame; and e. an umbilical line connector for receiving a power and control umbilical line from a support vessel for powering and controlling the tools.

13. The subsea well containment and intervention apparatus of claim 12, further comprising at least one buoyancy module mounted on the frame.

14. The subsea well containment and intervention apparatus of claim 12, wherein the frame is cross or X-shaped.

15. The subsea well containment and intervention apparatus of claim 12, further comprising a plurality of lifting eyes attached to the frame.

* * * * *